US006604804B2

(12) United States Patent
Asawaka

(10) Patent No.: US 6,604,804 B2
(45) Date of Patent: Aug. 12, 2003

(54) PRINT ON TWO PAGES CONCURRENTLY

(75) Inventor: Stuart Asawaka, San Diego, CA (US)

(73) Assignee: Hewlett-Packard Company, Palo Alto, CA (US)

( * ) Notice: Subject to any disclaimer, the term of this patent is extended or adjusted under 35 U.S.C. 154(b) by 90 days.

(21) Appl. No.: 09/902,019

(22) Filed: Jul. 10, 2001

(65) Prior Publication Data

US 2003/0011650 A1 Jan. 16, 2003

(51) Int. Cl.[7] ..... B41J 29/38

(52) U.S. Cl. ..... 347/14; 347/19; 400/708; 358/1.18

(58) Field of Search ..... 347/12, 14, 16, 347/19, 104; 400/708; 358/1.18, 449; 101/115

(56) References Cited

U.S. PATENT DOCUMENTS 3,603,585 A * 9/1971 Maloney ..... 271/259
4,208,666 A * 6/1980 Paranjpe ..... 347/2
4,453,841 A * 6/1984 Bobick et al. ..... 347/16
4,463,359 A * 7/1984 Ayata et al. ..... 347/56
4,631,596 A * 12/1986 Yaguchi ..... 358/449
4,813,351 A * 3/1989 Pierson, Jr. ..... 101/115
4,916,638 A * 4/1990 Haselby et al. ..... 347/16
5,526,107 A * 6/1996 Bronstein ..... 355/319
6,217,143 B1 * 4/2001 Munakata et al. ..... 347/16
6,260,947 B1 * 7/2001 Pinkernell ..... 347/43

* cited by examiner

*Primary Examiner*—Judy Nguyen
*Assistant Examiner*—Blaise Mouttet

(57) ABSTRACT

Methods and apparatus for improving printing efficiency are shown and described including recognition of a condition where print head swath height spans successive media including a gap therebetween. Such conditions provide opportunity to print concurrently on both media pages during one print head scan. This utilizes more fully the vertical swath height of the printer by applying when possible image to media exposed to the print head including successive media pages concurrently.

19 Claims, 5 Drawing Sheets

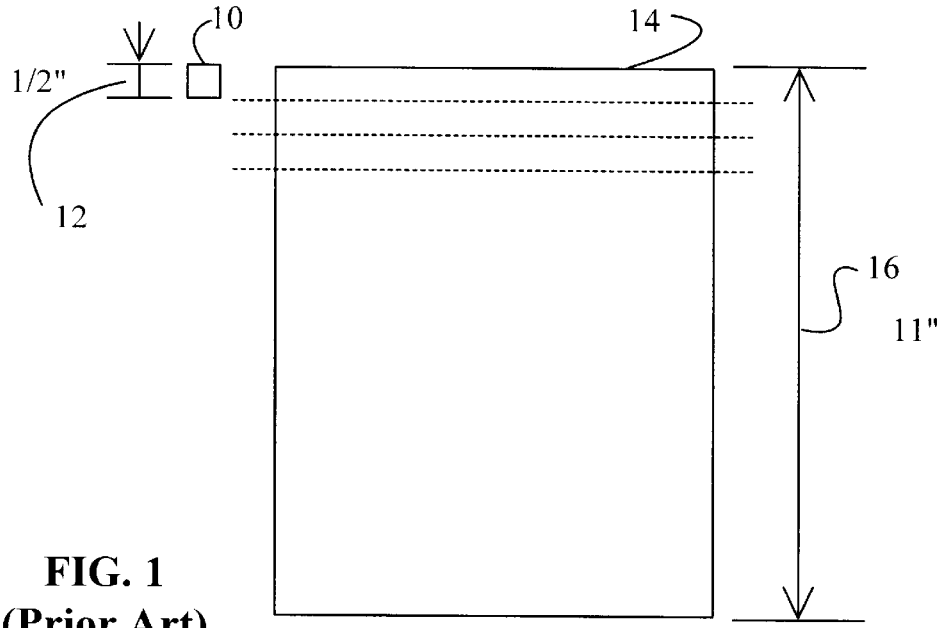
FIG. 1
(Prior Art)
FIG. 2
(Prior Art)
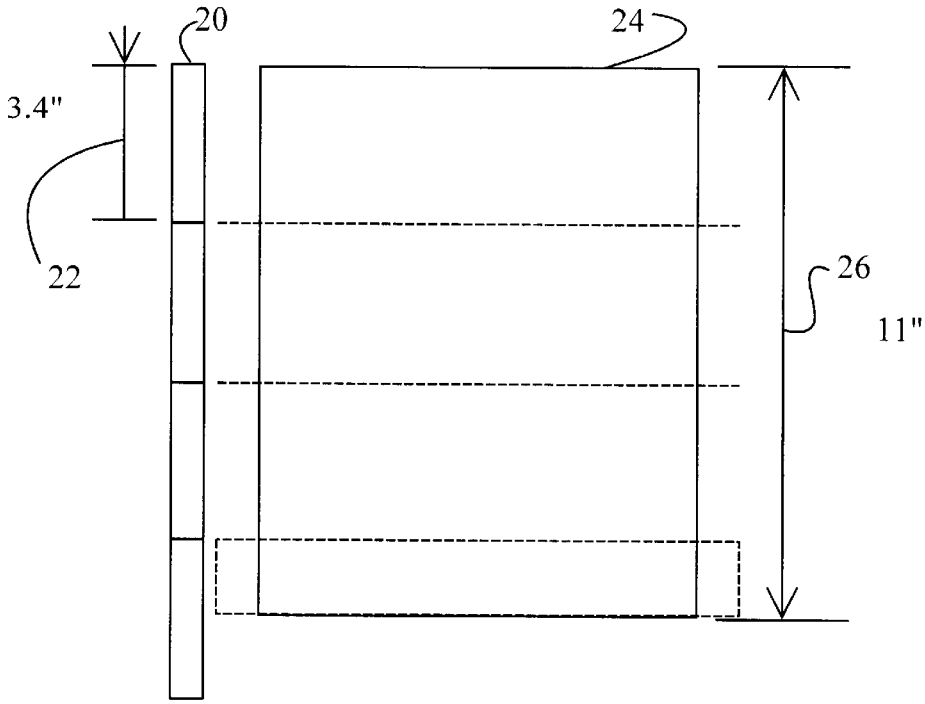

PRINT ON TWO PAGES CONCURRENTLY

BACKGROUND OF THE INVENTION

The present invention relates generally to printing apparatus, and particularly to ink-ejecting printing devices.

A print head includes an array of ink-ejecting nozzles. The print head scans, i.e., horizontally reciprocates, on a carriage across media and projects ink according to an intended image presentation, e.g., prints text or graphics across a page. A swath of image presentation across the page then lies along the print head swath path. The printer then advances the media past the print head swath path. By coordinating print head scanning, ink projection from the print head, and media advance, the printer deposits ink on the media in an appropriate pattern to generate the intended print image. A variety of methods of coordinating media advance and print head scanning have developed to efficiently deposit ink on the media. For example, some devices print in either direction, i.e., can print while the print head scans from right to left and can print while the print head scans from left to right.

Generally, the media advance distance equals the print head swath height. In other words, the print head lays down a pattern of ink across the page with a height or vertical distance, i.e., perpendicular to the scan direction, known as the "swath height." By executing a scan and print maneuver across the page width, the printer deposits an ink pattern, i.e., image swath, with a vertical height corresponding to the swath height. Advancing the media by a distance equal to the swath height and between successive printing scans eventually exposes to the print head the entire vertical and horizontal dimensions of the media and gives opportunity for the print head to deposit ink on the entire media.

In some cases, however, the media advance does not equal the swath height. For example, the paper advance distance is less than the swath height when the device executes multiple passes relative to a given portion of the page. This is typical in photographic or high resolution/multi-color printing jobs where the print head requires one or more "passes" over a given portion of the media. The media advance height may in some cases exceed the swath height. For example, when no printing is required the media advance can be significantly more than swath height. This action is also known as a "white space skip." As used herein, term "white space" or "blank data" refers to a print head ejecting no ink and adding no image presentation to media thereunder.

Print heads are characterized by the number of ink-dispensing nozzles, printer resolution or "dots per inch" (dpi), and the swath height. Swath height is a function of the number of nozzles and the desired resolution. More particularly, swath height equals the number of nozzles divided by the dpi resolution. The history of ink-ejecting printers includes an evolution of increasing dpi resolution to satisfy ever-increasing resolution and performance demands. Along with this evolution came a history of ever-increasing swath heights. Increasing swath heights are found throughout the printer manufacturing industry and across most printer manufacturing company model lines.

Thus, an ever-increasing swath height is expected. Unfortunately, larger swath heights introduce certain inefficiencies into the printing process. As will be appreciated, printing inefficiencies ultimately result in relatively less overall page throughput. More specifically, a larger swath height pays a greater penalty for "remainder swaths", i.e., where only a partial swath height is needed to complete a given page. A complete print head scan is required, but a complete swath of image is not produced. This results in inefficient use of scan time, i.e., time in which the print head scans across the page.

Smaller swath heights, as in the history of such printers, did not introduce significant inefficiencies due to the relative size of swath height and vertical dimension of a given page. More particularly, previous printing heads had swath heights at only a small percentage of the total needed, i.e., small compared to page length. Hence remainder swaths did not significantly impact page throughput. For example, the above-noted swath heights of $1/6^{th}$ inch (0.423 cm), $1/3^{rd}$ inch (0.847 cm) and ½ inch (1.27 cm) were small in comparison to the typical 11-inch (27.94 cm) page height. Thus, a relatively large number of print head scans were required for each page because the swath height was much, much smaller than the page height.

As swath height grows, however, the need for an additional swath or print head scan represents a correspondingly more significant portion of the overall page and, therefore, the overall print time required for that page. Thus, inefficient use of print head scan time, i.e., such as resulting from printing using only a portion of swath height, represents a potential for increasing inefficiency as swath heights grow in comparison to the typical page height. Such "remainder swaths" occur when an integer multiple of the swath height mismatches page height. Thus, for example if the swath height were equal to the page height then no remainder swath issue arises. Similarly, for an integer multiple of the swath height equal to the page height no remainder swath issue arises. In other words, if an integer multiple of the swath height equals the printing area of the page, then no remainder swaths will occur, i.e., no condition occurs where only a portion of the swath height is used for printing. Unfortunately, users designate different sized media and set margins of varying dimensions. As a result, the actual printing area on a given page varies and does not equal in every case an integer multiple of the swath height. Accordingly, remainder swaths arise as a source of throughput inefficiency.

FIG. 1 (Prior Art) illustrates schematically the relative size relationship between a print head 10 having a ½ inch (1.27 cm) swath height 12 and a page 14 having an 11 inch (27.94 cm) page height 16. To cover the entire page 14, print head 10 must scan across page 14 at least 22 times, i.e., ½ inch (1.27 cm) vertical coverage for each scan and 22 total scans to cover 11 inches (27.94 cm). In this typical prior art configuration, each swath height 12 corresponds to 4.5% of the page height 16. Thus, an additional scan required at the bottom of a page, but only utilizing a portion of the print head 10 swath height 12, represents at most an inefficiency of nearly 4.5% relative to the overall page 14.

Printer swath heights are increasing and are expected to increase significantly. As swath heights increase, greater inefficiencies will result. For example, swath heights of several inches are foreseeable. Future ink-ejecting printers will likely have even greater swath heights.

FIG. 2 (Prior Art) illustrates significant inefficiency under prior art printing methods as swath heights increase relative to typical page height. In FIG. 2, print head 20 enjoys, for example, a 3.4-inch (7.62 cm) swath height 22. Page 24 has a page height 26 of 11 inches (27.94 cm). To guarantee coverage of the entire page 24, print head 20 must scan at least four times. Thus, under the configuration illustrated in FIG. 2, each scan or swath height 22 represents 25% of the required page 24 printing operation. An inherent and significant inefficiency arises because the relative size of the swath height 22 and page height 26 invariably results in a certain portion of the last print head 20 scan not utilizing a full swath height 22. Thus, for a final scan of page 24 utilizing a very small portion of the swath height 22, a nearly 25% inefficiency in page throughput relative to scan time results.

It would be desirable, therefore, to adapt to ever-increasing swath heights while not suffering the ever-increasing page throughput inefficiencies resulting from increased swath height.

SUMMARY OF THE INVENTION

The present invention proposes more efficient use of scan time by coordinating successive media transport to identify a gap or separation between successive media less than the swath height and to print when possible on two consecutive media concurrently during a single print head scan, i.e., when print head swath height spans a gap between successive media.

The subject matter of the present invention is particularly pointed out and distinctly claimed in the concluding portion of this specification. However, both the organization and method of operation of the invention, together with further advantages and objects thereof, may best be understood by reference to the following description taken with the accompanying drawings wherein like reference characters refer to like elements.

BRIEF DESCRIPTION OF THE DRAWINGS

For a better understanding of the invention, and to show how the same may be carried into effect, reference will now be made, by way of example, to the accompanying drawings in which:

FIG. 1 (Prior Art) illustrates prior printing methods including a relatively small swath height in comparison to page height.

FIG. 2 (Prior Art) illustrates prior printing methods including significant inefficiencies where swath height represents a significant portion of page height.

DETAILED DESCRIPTION OF THE PREFERRED EMBODIMENT

The present invention recognizes the inefficiency resulting from certain swath heights. More particularly, certain swath heights represent a mismatch with page or printing area height. Remainder swaths occur when an integer multiple of swath height mismatches page or printing area height. Greater efficiencies are possible under the present invention when for each scan of a print head as much as possible of the vertical swath height results in printing. In accordance with the present invention, a print head prints on a page at its bottom portion and on a next page across its top portion in a single scan. A first upper portion of the swath height prints on one page and a second lower portion of the swath height prints on a successive page.

Figure 3:
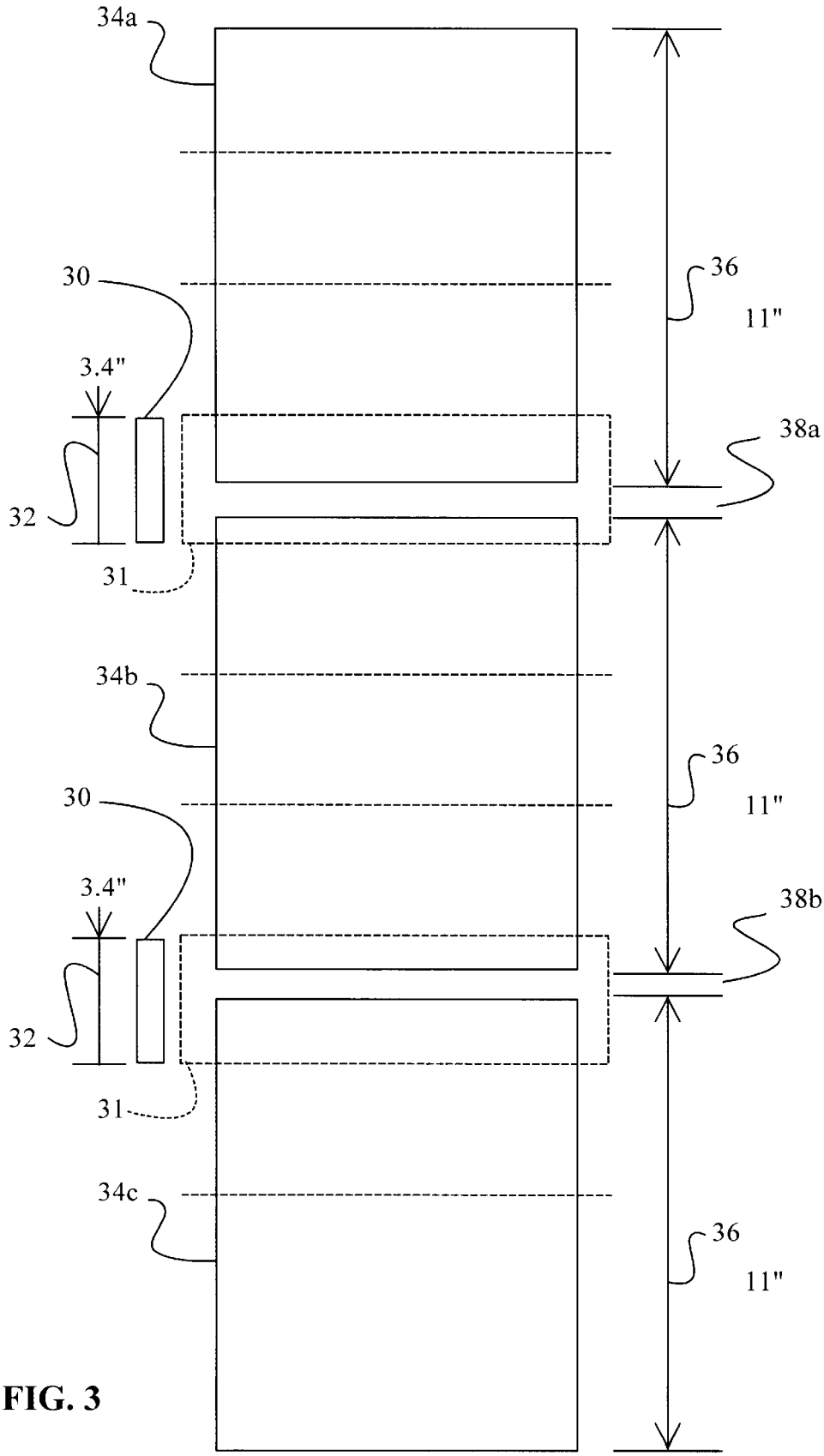
FIG. 3 illustrates printing methods according to the present invention where a print head swath height spans a gap between successive pages and takes the opportunity to print on two successive pages concurrently in a given print head scan.

FIG. 3 illustrates application of the present invention to resolve inefficiencies resulting from relatively larger swath heights. In FIG. 3, a print head 30 has a 3.4-inch (7.62 cm) swath height 32. A series of pages, individually 34*a*–34*c*, pass or "advance" as a page train past the horizontal swath path 31 of print head 30. Pages 34*a*–34*c* have a vertical height 36 of 11 inches (27.94 cm). A tailgate gap 38 exists between the trailing edge of one of pages 34 and the leading edge of a next one of pages 34. When the swath path 31 for print head 30 spans one of gaps 38 and extends far enough into the next page 34 to contribute to printing thereat, print head 30 makes use of this lower portion of its swath height 32 to print on the next page 34.

FIG. 3 actually shows multiple swath paths 31 vertically displaced. In fact there is only one swath path 31 and the pages 34 advance past swath path 31. But for purposes of illustration, pages 34 are shown stationary and the swath path 31 is shown in various vertical offsets to illustrate the movement of pages 34 relative to a stationary swath path 31. It should be understood, therefore, that in fact the pages 34 advance by swath path 31 which is vertically stationary. Thus, printer head 30 is vertically stationary and only horizontally moves across the swath path 31.

In the particular illustration of FIG. 3, print head 30 currently spans the gap 38*a* between pages 34*a* and 34*b*. The upper portion of print head 30 makes a last scan across page 34*a* to complete printing thereon. The bottom portion of print head 30 extends far enough onto page 34*b* to include a portion of page 34*b* requiring printing. In accordance with the present invention, print head 30 makes use of the same scan used to print the last portion of an image on page 34*a* to also print the first portion of an image on page 34*b*.

Thus, in one scan print head 30 completes printing on page 34*a* and begins printing on page 34*b*. Conditions supporting such printing method include print head 30 spanning a gap 38 and extending sufficiently across two pages 34 to extend into the regions of such pages 34 requiring printing. As may be appreciated, factors dictating such conditions include the extent of gap 38 between the trailing edge of a given page 34 and the leading edge of a next page 34. Top margin or bottom margin printing parameters set for the given print job dictate where printing will occur. Generally, print head 30 must span the lower portion of a printing area on a given page 34 and the upper portion of a printing area on a next page 34. When such conditions occur, print head 30 prints on two pages at once.

For a succession of three pages, i.e., pages 34*a*–34*c*, having an 11 inch (27.94 cm) height 36 and a print head 30 having a 3.4 inch (7.62 cm) swath height 32, a maximum of ten scans are required to print pages 34*a*–34*c*. This assumes a ½ inch (1.27 cm) gap 38 between pages 34. In comparison, prior art methods of printing would require twelve scans to cover entirely the collective vertical heights 36 of pages 34.

It will be understood that a variety of paper transport mechanisms and data management schemes may be employed to implement the present invention. Generally, detecting and measuring the size of a gap 38 between successive pages 34 and detecting the presence of such gap 38 within the horizontal swath path 31 triggers steps associated with the present invention. More particularly, printing is modified in such manner to make use of a lower portion of the swath height 32 to print if possible on a next successive page 34.

The following specific embodiment of the present invention is shown to illustrate generally one implementation of the present invention. It will be understood, therefore, that a particular actual implementation of the present invention may vary according to specific hardware architecture, programming methods, and distribution of processing responsibility between a host PC and a printing device. The following description is meant to illustrate sufficiently one example of the present invention to allow implementation thereof across a variety of specific hardware environments and programming arrangements.

FIGS. 4–9 illustrate implementation of the present invention with respect to a printer 100 including an ink-ejecting print head 130. Print head 130 has a swath height 132 corresponding to its particular characteristics, i.e., number of nozzles and resolution setting. Printer 100 also includes a paper transport mechanism 102 shown schematically in FIG. 4. Mechanism 102 is of conventional paper picking and transport methods. It will be understood, that mechanism 102 passes a succession of pages 134, individually pages 134*a* and 134*b* in FIG. 4, past print head 130. Print head 130 moves horizontally through a swath path 31 across pages 134 as pages 134 move therepast. Mechanism 102 moves pages 134 in a page advance direction 104. The picking and transport features of mechanism 102 collect papers for presentation to print head 130 with a given gap 138 therebetween. For example, the gap 138*a* in FIG. 4 corresponds to a gap 138 between pages 134*a* and 134*b*. A gap sensor 106 detects and reports the vertical height of gaps 138 each as an input G 106*a* to printer 100. In conjunction with mechanism 102 encoding or other such position detecting mechanisms, printer 100 thereby locates each gap 138 relative to print head 130 and holds a value G corresponding to the height or size of each gap 138. As will be discussed more fully hereafter, when a gap 138 appears within the swath path 31 of print head 130, printer 100 makes use of input G 106*a* to modify printing in accordance with the present invention.

In the following example, printer 100 is a scanning traversing carriage printer, i.e., carries print head 130 on a horizontally reciprocating carriage (not shown). The host PC 150 printer driver 150*a* utilizes at least one, but preferably two buffers (110 and 112). One buffer (110) holds the data corresponding to what print head 130 prints in one pass or swath across a page 134. The invention may be implemented, however, across many device configurations and the particular configuration shown herein merely illustrates one example of the present invention.

Figure 4:
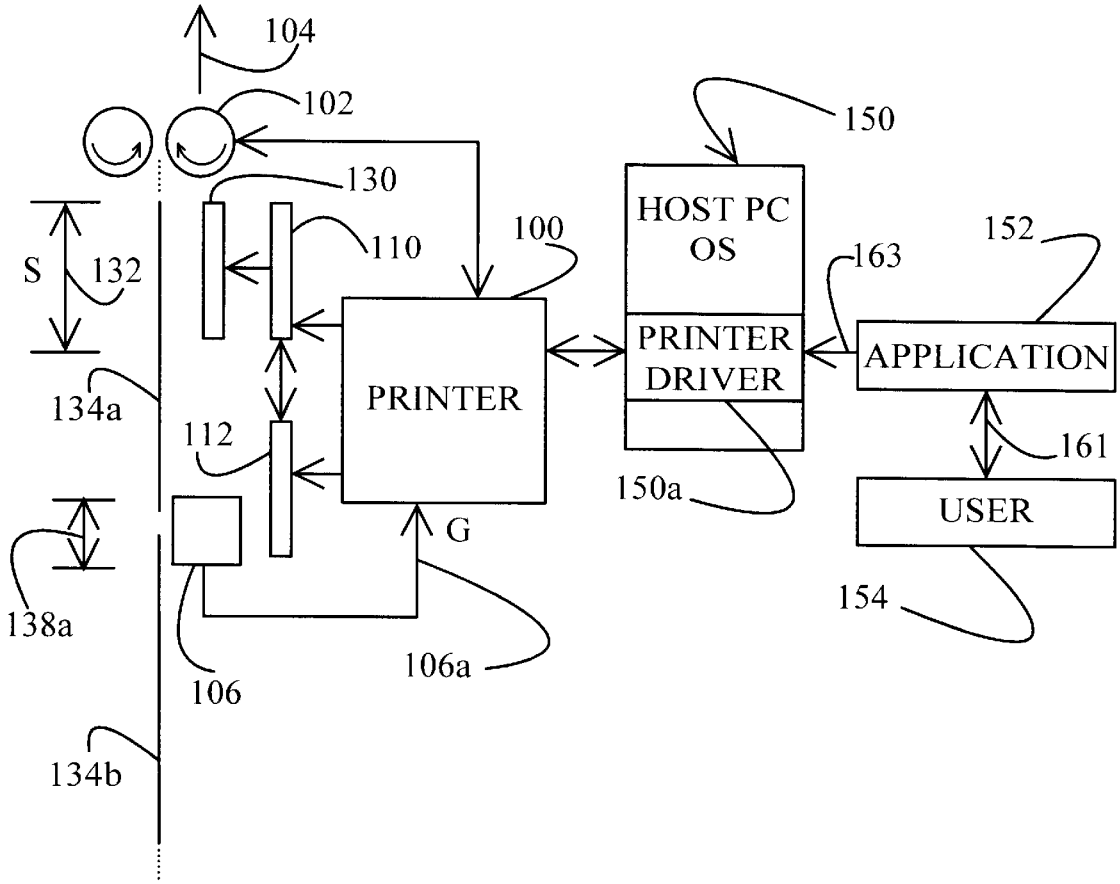
FIG. 4 illustrates schematically by block diagram a printer operating in accordance with the present invention including printing on two pages concurrently.

In FIG. 4, a swath buffer 110, e.g., RAM (memory), holds enough data to execute one printing scan, i.e., it holds the data applied to the print head 130 to produce an image swath, i.e., to print, across page 134. Normal printing operations include also movement of pages 134 along direction 104 by way of paper transport mechanism 102. The distance being equal to the swath height 132 in most cases. As discussed herein, efficiencies are described with respect to conserving scan time relative to single-pass printing. The invention applies equally, however, to printing modes which require multiple passes across a given portion of the page, i.e., where the print head 130 passes across a page 134 several times in the same region such as in shingled color printing modes. Where an increase in efficiency is obtained for single pass modes, a similar efficiency is obtained for multiple pass modes. The following discussion focuses, therefore, only on single-pass printing modes but applies to multiple-pass printing modes.

Thus, it will be understood that printer 100 in conjunction with its manipulation of mechanism 102, and if necessary receiving encoding information therefrom, has at any given time knowledge of where a gap 138 is located relative to print head 130. Accordingly, printer 100 detects precisely when a gap 138 moves within the swath path 31 of print head 130. The end of a page 134 and the start of the next page 134 are determined by a variety of devices. For example, an optical paper edge sensor or a simple mechanical switch. In conjunction with paper transport mechanism 102 position information, e.g., encoding, printer 100 senses the actual size and position of a gap 138 as it approaches print head 130. The value assigned to G and, as discussed more fully hereafter, the size of blank data inserted into the swath buffer 110 varies for each measurement of a gap 138. This accounts for variations in each gap 138 as due to variation in mechanical transport of pages 134, e.g., paper picking devices vary slightly from sheet to sheet.

A holding buffer 112 is used by printer 100 to prepare data for placement into swath buffer 110 and, eventually, printing on one of pages 134. The use of swath buffer 110 and holding buffer 112 is described more fully hereafter.

The example of FIG. 4 includes a host PC 150 executing thereon an application program 152. A user 154 interacting with application 152 initiates a printing operation at printer 100 in conventional fashion through a printer driver 150*a* of host PC 150, e.g., the driver 150*a* being typically found in the host PC 150 operating system. Printer driver 150*a* converts application formatting into printer specific rendering. For example, if printer 100 operates at a resolution of 600 dpi, the images are processed on a 600 dpi grid. If a print head 130 has 2040 nozzles, the formatting maps the application format into the appropriate swath data format directly applicable to that specific print head 130.

Figure 5:
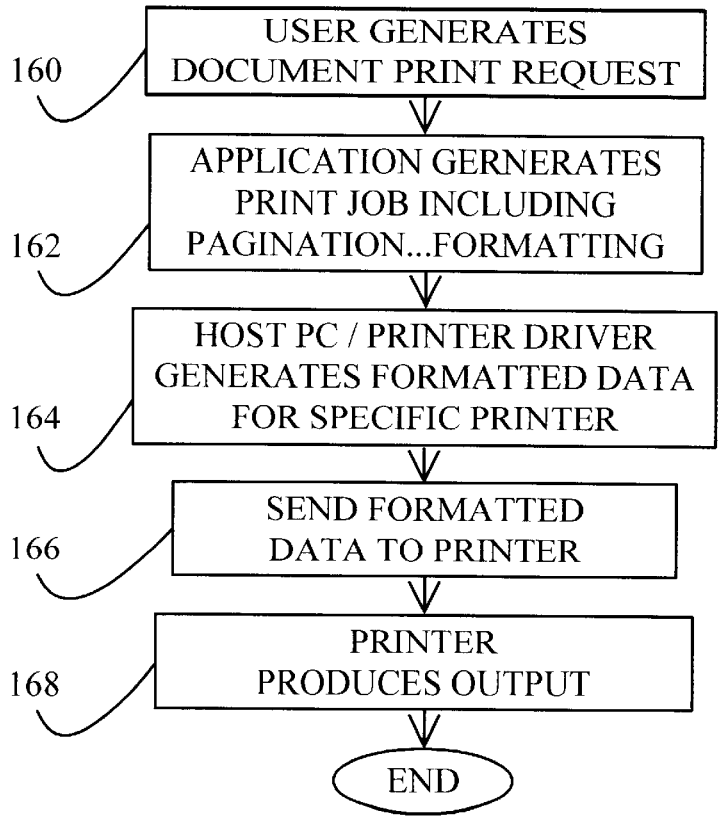
FIG. 5 illustrates by flow chart steps conducted in association with printing on two pages in accordance with the presence invention.

FIG. 5 illustrates activity associated with printer 100 producing output, i.e., ejecting image patterns from print head 130 onto pages 134. In FIG. 5, user 154 generates a document print request in block 160. In block 162, application 152 generates a print job including pagination, page breaks and the like according user formatting by way of application 152. Printer driver 150*a* receives the print job and generates formatted data suitable for the specific printer 100, i.e., for the specific nozzle configuration of print head 130. Host PC 150 sends in block 166 formatted data to printer 100. Block 168 represents the action of printer 100 processing the formatted data and producing output as more specifically illustrated in FIG. 6. While described hereafter in relation to processing activities by printer 100, it will be understood that processing responsibilities may be distributed according to a variety of well-known methods between printer 100 and host PC 150.

Figure 6:
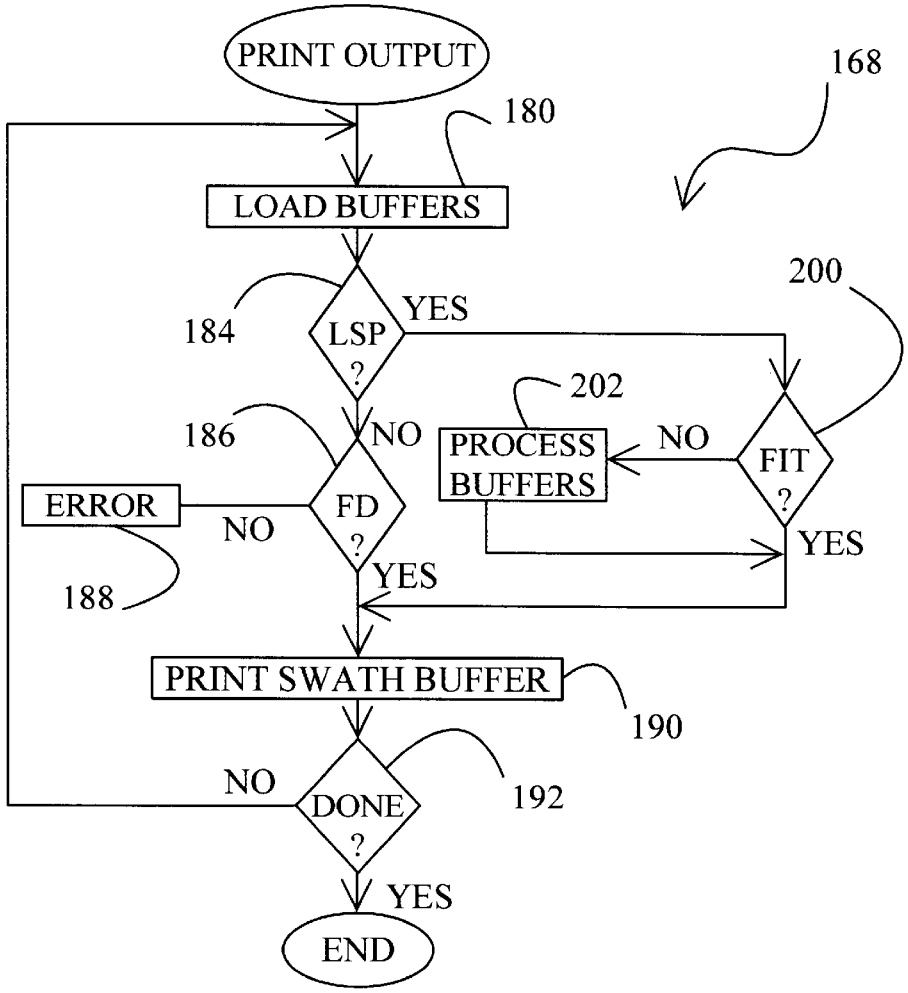
FIG. 6 illustrates more specifically by flow chart steps conducted in association with printing on two pages concurrently under the present invention.

In FIG. 6, the block 168 process of producing printer output begins in block 180 where printer 100 loads swath buffer 110 and holding buffer 112. When first executed, i.e., at the very beginning of producing print output, printer 100 first fills swath buffer 110 with formatted data and then fills holding buffer 112 with formatted data. Printer 100 makes use of a pointer into the formatted data IO stream and, as described more fully hereafter, has ability to adjust by offsetting such pointer where formatted 10 data may be taken from the formatted 10 data stream. In this particular example, it is at times necessary to repeat collection of certain data from the formatted data IO stream as described more fully hereafter. Subsequent execution of block 180, i.e., other than the initial execution, simply moves all data from holding buffer 112 into swath buffer 110. In other words, block 180 more typically simply shifts holding buffer 112 contents into swath buffer 110. This action typically occurs following a printing scan, i.e., after the contents of swath buffer 110 have been applied to print head 130 to produce an image across a page 134. Following this action, the contents of holding buffer 112 are shifted into swath buffer 110 and holding buffer 112 is then available to receive a next segment of the formatted data IO stream. Thus, following block 180 swath buffer 110 holds a collection of formatted data proposed for application to print head 130.

In decision block 184 printer 100 determines whether this swath, i.e., that data held currently in swath buffer 110, constitutes the last swath on the current page 134. If this is not the last swath on the current page 134, then processing advances to decision block 186 where printer 100 determines if swath buffer 110 contains formatted data suitable for application to print head 130. If swath buffer 110 does not contain valid formatted data, then processing branches to an error block 188. Otherwise, processing branches from decision block 186 to block 190 where printer 100 applies swath buffer 110 data to print head 130 as it executes a printing scan across the current page 134. At this point, swath buffer 110 has been applied to page 134. Block 190 includes as necessary page advance controls applied to mechanism 102 to suitably advance pages 134 along page advance direction 104. Following block 190, processing advances to decision block 192 where printer 100 determines if the print job is complete. If the print job is done, then processing terminates. Otherwise, processing returns to block 180 where the contents of holding buffer 112 shift into swath buffer 110 and holding buffer 112 receives the next segment of the formatted data IO stream.

Returning to decision block 184, if printer 100 determines that the swath data present in swath buffer 110 is the last swath for this page, then processing branches to decision block 200. In block 200, printer 100 determines if the swath data present in swath buffer 110 will fit completely on the current page 134. In other words, printer 100 makes use of its knowledge of the size and position of gap 138 relative to print head 130 and determines when print head 130 spans a gap 138, i.e., when the swath data held in buffer 110 does not fit on the current page 134. If the swath data in swath buffer 110 does fit on the current page 134, however, processing branches directly from decision block 200 to decision block 190 where printer 100 produces a swath of image across page 134 using the current content of swath buffer 110.

Figure 7:
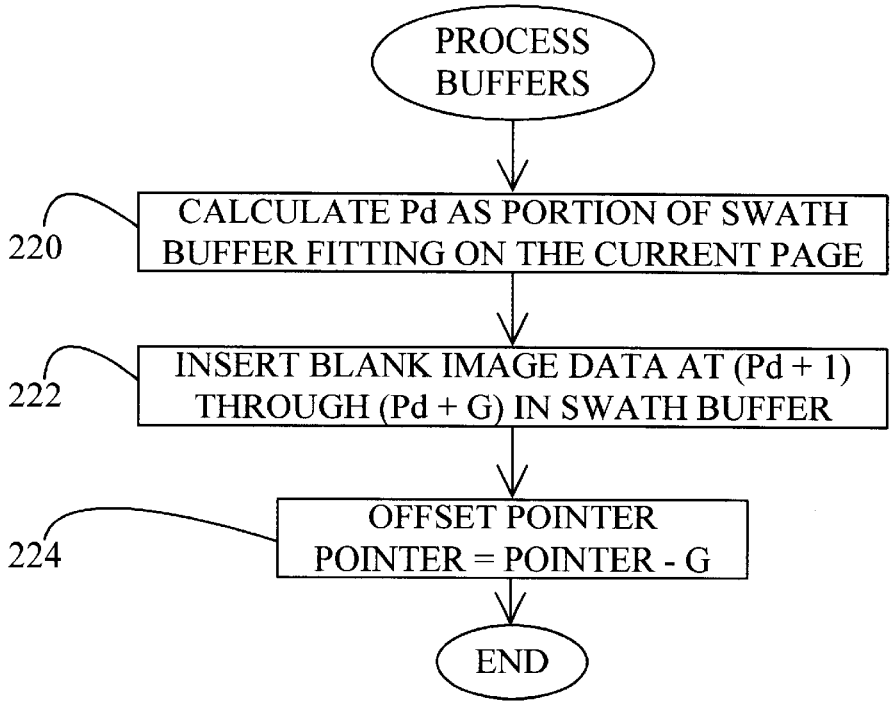
FIG. 7 details by flow chart processing steps associated with a particular embodiment of the present invention.

If, however, printer 100 determines in decision block 200 that the current data currently held in swath buffer 110 will not fit on the current page 134, processing branches from block 200 through block 202 where printer 100 processes buffers 110 and 112 according to this particular embodiment of the present invention. Generally, block 202, as described more fully hereafter and as shown in FIG. 7, prepares buffers 110 and 112 taking into account the presence of a gap 138 under print head 130 to produce a condition in buffers 110 and 112 suitable for processing in block 190.

The size of a segment of the formatted data stream is expressed herein as a portion of swath height. Thus, where S equals the swath height, e.g., 3.4 inches (7.62 cm), other segments are defined as follows:

Pd=partial data left in swath buffer 110

G=blank image/GAP between end of one page and beginning of next

R=remainder data

The three segment size values combine as a full swath buffer as follows:

$$S=Pd+G+R$$

and provide basis for the calculation:

$$R=S-Pd-G$$

For example, where Pd equals 1 inch (2.54 cm) and G equals ½ inch (1.27 cm), R is calculated as:

$$R=S-Pd-G=3.4-1-0.5=1.9$$

This indicates that for the next printer head 130 scan, the lower portion of print head 130 extends a distance R onto the next page 134. In accordance with the present invention, printer 100 loads the lower portion of swath buffer 110 with swath data applicable to the top portion of the next page 134.

For purposes of simplified illustration herein, margins (top and bottom of page) are taken as part of the formatted data stream and need not be discussed further. It will be understood, however, that buffer processing and manipulation can account for top and bottom page margins as necessary. For example, in reading a gap 138 value G 106*a* from detector 106, valuation for G can include margin offsets into the printing area of each page.

FIG. 7 illustrates in more detail the steps executed by printer 100 in block 202. In FIG. 7, printer 100 manipulates buffers 110 and 112 by calculating where a segment of blank data may be inserted into swath buffer 110 while concurrently "pushing back" an equivalent amount of previously stored formatted data, i.e., pushing back formatted data into the remainder portion of swath buffer 110 and into holding buffer 112.

In block 220, printer 100 calculates a value Pd as the portion of swath buffer 110 fitting on the current page. As used herein, the value Pd is expressed as a distance corresponding to a portion of the vertical swath height 132. For example, the value Pd may be expressed in inches as that portion of the upper part of the print head 130 capable of printing on the current page 134. In block 222 printer 100 inserts blank image data at (Pd+1) through (Pd+G) in the swath buffer 110. As indicated above, the notation as used herein for the variables Pd, G, S and R refer to blocks of formatted data or to blocks of data inserted into the data IO stream. Valuation for these terms has been expressed as a distance value, i.e., a portion of the swath height. It will be understood, however, that these values are in fact memory address values. Conversion to actual memory addresses within the data IO stream or within the buffers 110 and 112 is executed as necessary. Important to note, this is an "insert" operation pushing back data and not overwriting data. The blank image data inserted into swath buffer 110 represents a "white-image" for which no ink is projected from print head 130. In essence, this blank data causes print head 130 to leave a white-space image through a vertical portion of its swath height corresponding to the size of the blank data inserted into swath buffer 110.

Figure 8:
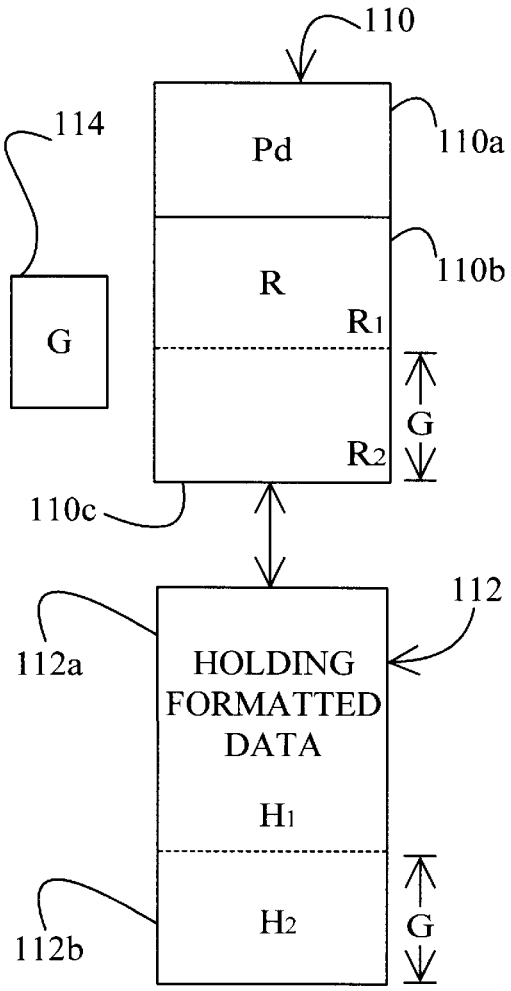
FIGS. 8 and 9 illustrate processing of data buffers in accordance with the present invention according to one embodiment thereof.
Figure 9:
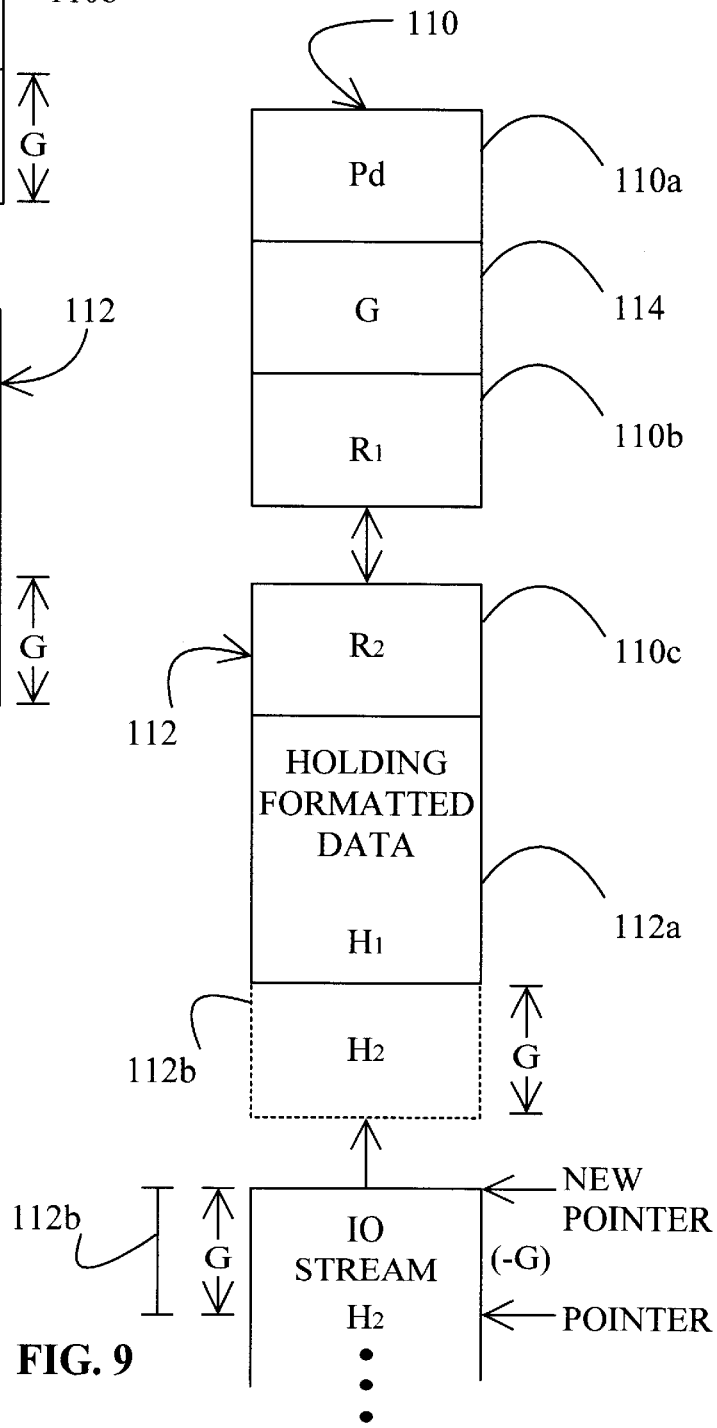

FIGS. 8 and 9 illustrate the insert operation conducted in block 222. In FIG. 8, swath buffer 110 includes swath data proposed for print. As determined in block 200, however, printer 100 executes block 222 where blank image data 114 is inserted into swath buffer 110 and as indicated in FIG. 9. The original contents of swath buffer 110 are illustrated in FIG. 8. A portion 110*a* corresponding to the value Pd and portions 110*b* and 110*c* corresponding to a value R are distinguished when inserting blank image data 114. More particularly, portion 110*a* corresponding to the value Pd remains in place. Portions 110*b* and 110*c*, however, must be moved or shifted backward in buffer 110 and if necessary into holding buffer 112.

FIG. 9 illustrates the condition of swath buffer 110 and holding buffer 112 following insertion of blank image data 114 into swath buffer 110. In FIG. 9, portion 110*a* corresponding to the value Pd remains in place at the upper portion of swath buffer 110. The blank image data 114 block, corresponding to a value G, resides in the next segment of swath buffer 110. Portion 110*b* ($R_1$) occupies the final segment of swath buffer 110 and the rest of any data shifted out of swath buffer 110, i.e., portion 110*c* ($R_2$) occupies the first or upper portion of holding buffer 112.

The data originally occupying holding buffer 112, i.e., as illustrated in FIG. 8, includes a ortion 112*a* and a portion 112*b*. Portion 112*a* ($H_1$) remains at the lower portion of holding buffer 112 while a "lost" portion 112*b* ($H_2$) of holding data 112 has been shifted out of holding buffer 112. Data 112*b* is not, however, actually lost. By adjusting the pointer used to access the formatted data IO stream, printer 100 repeats collection of data 112*b* ($H_2$), i.e., goes back and again collects from the formatted data IO stream that which was "lost" when manipulating buffers 110 and 112. Thus, block 224 of FIG. 7 illustrates manipulation of the data stream IO pointer to go back in the data IO stream a distance corresponding to G, i.e., the amount of data shift through buffers 110 and 112 and also corresponding to the magnitude of a given gap 138 present under print head 130.

Following block 224, processing returns to block 190 (FIG. 6) where printer 100 prints the current content of swath buffer 110 including deposit of image on two successive pages 134.

As described herein, processing relative to data manipulation, e.g., movement of data through buffers 100 and 110, has been described as under the control of printer 100. It will be understood, however, that a variety of distributed processing methods are available including allocation of such data management to the host PC 150. Similarly, the particular processing steps executed with respect to management of the formatted data IO stream as it is eventually formatted and applied to print head 130 may be executed according to a variety of known methods and hardware architectures. The present invention may be implemented across such variety of printing methods and hardware architectures. Generally, the present invention recognizes that printing may occur on two pages simultaneously when a print head swath path or swath height spans two successive media including a gap therebetween. When such conditions occur, opportunity to improve page throughput arises by printing on both media pages concurrently in a single printing scan, or in multiple scans across the same regions of both successive pages.

It will be appreciated that the present invention is not restricted to the particular embodiment that has been described and illustrated, and that variations may be made therein without departing from the scope of the invention as found in the appended claims and equivalents thereof.

What is claimed is:

1. A printer comprising:

an inkjet print head applying an image to media adjacent thereto;

media transport moving at least two media in succession past said print head, said at least two media having a gap therebetween, said print head applying said image concurrently to said at least two media; and a gap detector identifying the location of said gap relative to said printhead.

2. A printer according to claim 1 wherein said print head has a swath height, said swath height being greater than said gap.

3. A printer according to claim 2 wherein said print head moves in a direction transverse to said swath height.

4. A printer according to claim 1 wherein said print head is an ink-ejecting print head.

5. A printer according to claim 1 wherein said print head has a swath height, said print head applying said image concurrently to said at least two media when said swath height spans said gap.

6. A printer according to claim 1 wherein said printer operates under control of and in coordination with a host computer.

7. A printer comprising:

a print head applying an image to media adjacent thereto;

media transport moving at least two media in succession past said print head, said at least two media having a gap therebetween, said print head applying said image concurrently to said at least two media; and a gap detector identifying the size and location of said gap relative to said print head, said print head applying said image concurrently to said at least two media when said gap detection indicates presence of said gap adjacent said print head and indicates a size of said gap less than a swath height of said print head.

8. A printer comprising:

a print head applying an image to media adjacent thereto; and media transport moving at least two media in succession past said print head, said at least two media having a gap therebetween, said print head applying said image concurrently to said at least two media, wherein said printer receives a stream of image data representing said image and inserts into said image data a blank data block as a function of a detected size of said gap, said blank data block when applied to said print head causing said print head to leave a white space image.

9. A method of applying an image presentation to a succession of media, said method comprising the steps:

moving said succession of media past a print head, said print head having a swath height, said print head moving across a swath path transverse to said swath height;

detecting presence of a gap between first and second consecutive ones of said succession of media and within said swath height; and applying concurrently a first portion of said image presentation to said first one of said consecutive ones of said media and a second portion of said image presentation to said second one of said consecutive ones of said media.

10. A method according to claim 9 wherein said print head is an ink-ejecting print head.

11. A method according to claim 9 wherein method executes under control of and in coordination with a host computer.

12. A method of applying an image presentation to a succession of media, said method comprising the steps:

moving said succession of media past a print head, said print head having a swath height, said print head moving across a swath path transverse to said swath height;

detecting presence of a gap between first and second consecutive ones of said succession of media and within said swath height; and applying a first portion of said image presentation to said first one of said consecutive ones of said media and a second portion of said image presentation to said second one of said consecutive ones of said media, wherein said step of detecting presence of a gap identifies a size and a location of said gap relative to said print head.

13. A method according to claim 12 wherein said applying step occurs when said gap size is less than said swath height.

14. A method of applying an image presentation to a succession of media, said method comprising the steps:

moving said succession of media past a print head, said print head having a swath height, said print head moving across a swath path transverse to said swath height;

detecting presence of a gap between first and second consecutive ones of said succession of media and within said swath height; and applying a first portion of said image presentation to said first one of said consecutive ones of said media and a second portion of said image presentation to said second one of said consecutive ones of said media, wherein said method comprises receiving a stream of image data representing said image presentation and said applying step comprises inserting into said image data stream a blank data block as a function of a detected size of said gap, said blank data block when applied to said print head causing said print head to leave a white space image.

15. An ink-ejecting printer comprising:

a print head traversing in a first direction a swath path and having in a second direction a swath height, said first and second directions being mutually orthogonal;

a media transport mechanism moving in a page advance direction a series of media past said print head swath path, successive ones of said media having a gap therebetween; and a print controller detecting the presence of one of said gaps adjacent said swath path and concurrently printing from said print head on consecutive ones of said series of media.

16. A printer according to claim 15 wherein print control operates under control of and in coordination with a host computer.

17. An ink-ejecting printer comprising:

a print head traversing in a first direction a swath path and having in a second direction a swath height, said first and second directions being mutually orthogonal;

a media transport mechanism moving in a page advance direction a series of media past said print head swath path, successive ones of said media having a gap therebetween; and a print controller detecting the presence of one of said gaps adjacent said swath path and printing from said print head on consecutive ones of said series of media, wherein said gap detection identifies a size of said gap relative to said swath height.

18. An ink-ejecting printer comprising:

a print head traversing in a first direction a swath path and having in a second direction a swath height, said first and second directions being mutually orthogonal;

a media transport mechanism moving in a page advance direction a series of media past said print head swath path, successive ones of said media having a gap therebetween; and a print controller detecting the presence of one of said gaps adjacent said swath path and printing from said print head on consecutive ones of said series of media, wherein said gap detection identifies a position for said gap relative to said swath path.

19. An ink-ejecting printer comprising:

a print head traversing in a first direction a swath path and having in a second direction a swath height, said first and second directions being mutually orthogonal;

a media transport mechanism moving in a page advance direction a series of media past said print head swath path, successive ones of said media having a gap therebetween; and a print controller detecting the presence of one of said gaps adjacent said swath path and printing from said print head on consecutive ones of said series of media, wherein said printer receives a stream of image data representing an image to be printed and said printer inserts into said image data stream a blank data block as a function of a detected size of said gap, said blank data block when applied to said print head causing said print head to leave a white space image.

* * * * *